US006003530A

United States Patent [19]

Giuseppe

[11] Patent Number: 6,003,530

[45] Date of Patent: Dec. 21, 1999

[54] AUTOMATIC AND MANUAL WASHING APPARATUS, WORKING AT VARIABLE CONDITIONS, FOR SPRAY GUNS AND THEIR COMPONENTS

[75] Inventor: Rosa Giuseppe, Montebello Vicentino, Italy

[73] Assignee: Rosauto S.R.L., Vicenza, Italy

[21] Appl. No.: 09/076,570

[22] Filed: May 12, 1998

[51] Int. Cl.[6] ..... B08B 3/00

[52] U.S. Cl. ..... 134/102.1; 134/98.1; 134/102.2; 134/103.2; 134/166 C; 134/169 C; 134/170

[58] Field of Search ..... 134/98.1, 102.2, 134/103.2, 166 C, 169 C, 170, 102.1, 200

[56] References Cited

U.S. PATENT DOCUMENTS

| | | | |
|---|---|---|---|
| 4,025,363 | 5/1977 | De Santis | 134/102 |
| 4,688,918 | 8/1987 | Suzuki et al. | 354/325 |
| 4,785,836 | 11/1988 | Yamamoto | 134/56 R |
| 4,827,955 | 5/1989 | Stern | 134/99 |
| 4,923,522 | 5/1990 | Sowers | 134/22.1 |
| 4,944,320 | 7/1990 | Waite et al. | 134/67 |
| 5,039,349 | 8/1991 | Schoeppel | 134/26 |
| 5,143,102 | 9/1992 | Blaul | 134/58 R |
| 5,193,561 | 3/1993 | Robb et al. | 134/57 R |
| 5,213,119 | 5/1993 | Kusz et al. | 134/95.3 |
| 5,220,933 | 6/1993 | Albers | 134/111 |
| 5,232,299 | 8/1993 | Hiss | 401/143 |
| 5,423,917 | 6/1995 | Garcia, Jr. | 134/1 |
| 5,511,568 | 4/1996 | Bowman et al. | 134/102.2 |
| 5,526,841 | 6/1996 | Detsch et al. | 137/15 |
| 5,707,457 | 1/1998 | Yates | 134/30 |
| 5,803,109 | 9/1998 | Rosen | 137/15 |

*Primary Examiner*—Frankie L. Stinson
*Assistant Examiner*—Paul J. Lee
*Attorney, Agent, or Firm*—Hedman, Gibson & Costigan

[57] ABSTRACT

A washing apparatus for spray guns and their components wherein a washing operation is provided which is realized by feeding clean liquid and air.

6 Claims, 4 Drawing Sheets

AUTOMATIC AND MANUAL WASHING APPARATUS, WORKING AT VARIABLE CONDITIONS, FOR SPRAY GUNS AND THEIR COMPONENTS

The present invention refers to an automatic and manual washing apparatus, working at variable conditions, for spray guns and their components.

Several devices and apparatus are currently known which allow to wash the spray guns and their components utilised in the industry for painting and for similar operations.

It has to be understood that the spray guns and their components, which are utilised in the industry, must always be particularly efficient in order to perform their task in the best possible way and with good results.

Their use, on the other hand, causes often the inside formation of deposits of colour and of other components with the consequent deterioration in their performances.

Further drawbacks can occur during their use, especially when it is not always possible to stop an ongoing painting operation. In fact, an interruption would cause unwanted painting unevenness because of the possible change of the application and drying conditions of the used liquid.

Apparatuses, able to forcefully put in contact the spray guns and their components with solvents so as to clean them, have already been realised. These apparatuses have washing tanks, provided with complicated systems for discharging the solvent used for the cleaning operations. This solvent, in some known apparatus, is recovered and sent back to the nozzles located in the tank, said nozzles directing the solvent on the guns and on their components or on accessories to be washed. This fact sometimes causes ineffective washing.

In other known apparatuses, the solvent is substituted continuously and therefore said solvent is used in significant amount with consequent high costs. In fact, besides the costs for the solvent, the costs relative to the purification or the elimination of the solvent must be added.

In this way it is not possible to obtain a good cleaning of the spray guns and of the associated components during operations, or said cleaning can be obtained with means economically non competitive for the user.

A general purpose of the present invention is to solve the above mentioned technical problems, while overcoming the drawbacks, and to realise, in any case, a particularly effective washing apparatus.

Another purpose is to simplify, if possible, the structure of the known washing apparatuses in a simple, quite economical and functional way, so as to be able, at any rate, to perform a perfect cleaning operation.

In order to achieve the above purposes, according to the present invention, an automatic and manual washing apparatus, working at variable conditions, for spray guns and their components has been realised, said apparatus having the characteristics disclosed in the appended claims.

In particular, this apparatus allows to obtain significant advantages over the known apparatuses with savings in the use of washing liquid or of solvent, and with better washing performances; further, the whole operation will not require any human intervention on the apparatus.

The structural and functional characteristics of the invention as well as its significant advantages in comparison with the known art apparatuses will be clearer and more evident through the analysis of the following description, referred to the appended drawings, which show examples of an apparatus and of components of said apparatus according to the invention.

Figure 1:
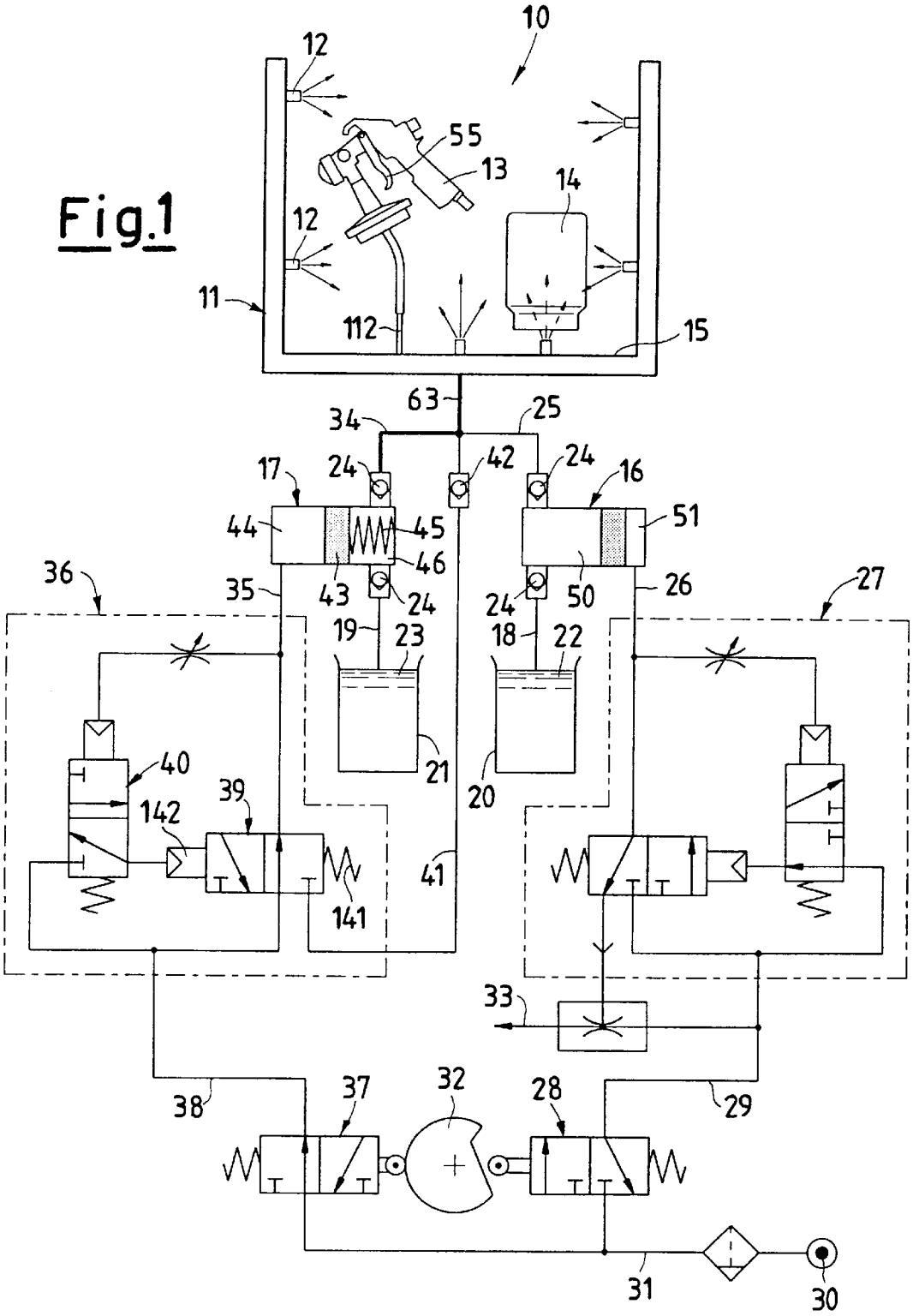
FIG. 1 is a schematic view of a washing apparatus for spray guns and their components wherein a washing tank is shown with its working connections to the pumps of liquid or solvent herein used in a first working condition during the second washing phase with clean liquid.

An automatic and manual washing apparatus, working at variable conditions, for spray guns and their components according to the present invention comprises a frame structure, not shown, whereon the various component elements are placed. Generally said structure comprises an area whereon a washing tank, indicated by numeral 10, is located and an area wherein various feeding and auxiliary systems belonging to the apparatus, not shown, are located.

In general, by reference to the drawings, inside the washing tank 10 there is a series of ducts 11 for distributing the washing fluid, said ducts are provided with a series of nozzles 12 suitable to direct cross jets towards the tools to be washed, as, for instance, a spray gun body 13 and a tank 14 for use with said gun.

Figure 5:
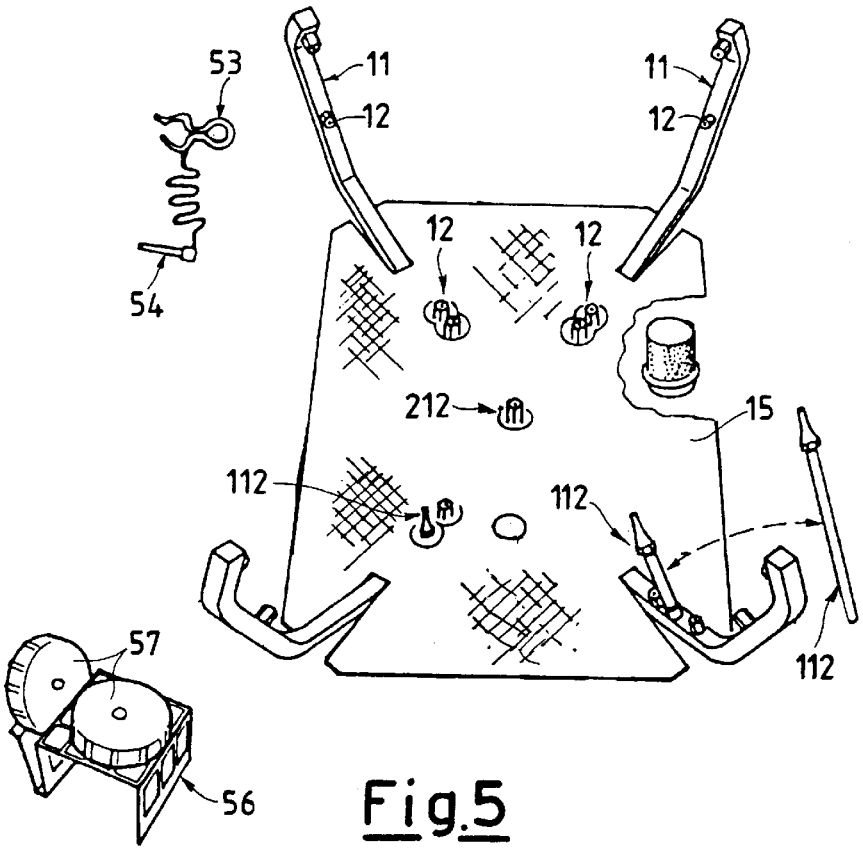
FIG. 5 shows a perspective view of a detail of the bottom portion of the tank with some of its element shown in exploded view and with auxiliary washing elements.

The tank 10 can further comprise a bottom wall 15 wherefrom portions of said ducts 11 project as shown in FIG. 5. The series of ducts 11 is connected, in the lower portion of the apparatus, to a couple of pumping elements, e.g. the pumps 16 and 17 connected through the ducts 18 and 19 to two containers or storage tanks 20 and 21.

The first tank 20 contains a liquid 22 already used or dirty, while the second storage tank 21 contains a clean liquid 23.

Downstream, the first pumping element 16 has, on the duct 18 connected to the storage tank 20, a single-acting valve 24 which is also provided on a duct 25 connected to the series of ducts 11.

Upstream, the first pumping element 16 is connected through a duct 26 to a pneumatic system which comprises a valve group 27 which is controlled through a further three-way valve 28 positioned on duct 29. This valve 29 can also be connected to a pressurised network system in 30 through a duct 31, and said valve is controlled by a timer, which has, for instance, a rotating control cam 32.

The first valve group 27, according to the example of the two three-way valves, allows to have a time controlled pumping of the dirty fluid, in function of the adjustable throttling device and of the control device realised as well by means of the pneumatic system, and a throttling connection, indicated by numeral 33.

The second pumping element 17 has an arrangement perfectly identical to that of the first pumping element 16 with single-acting valves 24 positioned both on the duct 19 and on the duct 34 towards the series of ducts 11. Upstream, the second pumping element 17 is connected through a duct 35 to a pneumatic system which comprises a further valve group 36 which is controlled through a further valve 37 positioned on duct 38, said valve is actuated by said timer, which has a rotating control cam 32. The valve group controls the continuous motion of the liquid pumping element 17 through the feeding of control air 30.

This further valve group 36 allows, through its three-way valve 39, controlled by another three-way valve 40, the timed feeding of air by means of a duct 41, provided with a single-acting valve 42, towards the series of ducts 11.

It should also be noted that the ducts 25 and 34, connected to the two pumping elements 16 and 17, and the air duct 41 cross each other at just one duct portion 63 which enters directly into the series of ducts 11.

Figure 2:
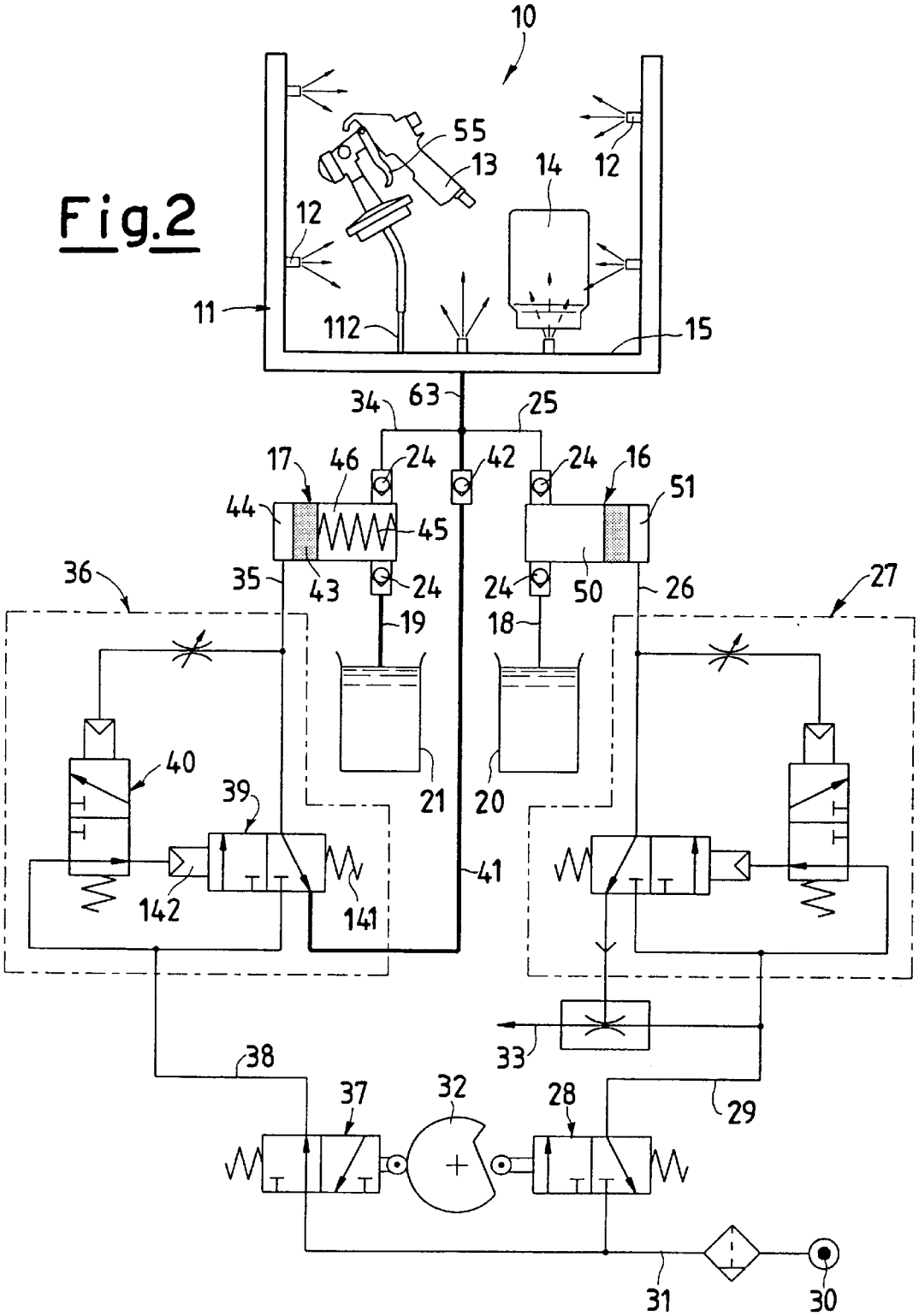
FIG. 2 is a view, similar to that shown in FIG. 1, of the washing apparatus for spray guns, in a second working condition during the second washing phase with clean liquid.
Figure 3:
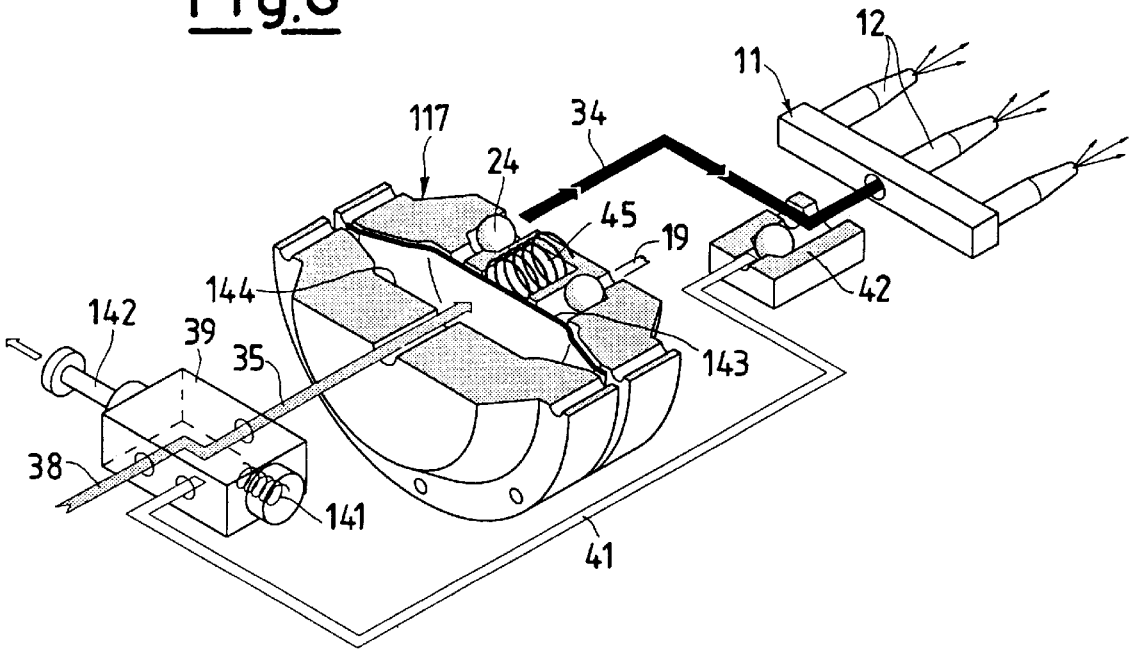
FIGS. 3 and 4 show a diagram of the second pump system in the two different working conditions shown in FIGS. 1 and 2.
Figure 4:
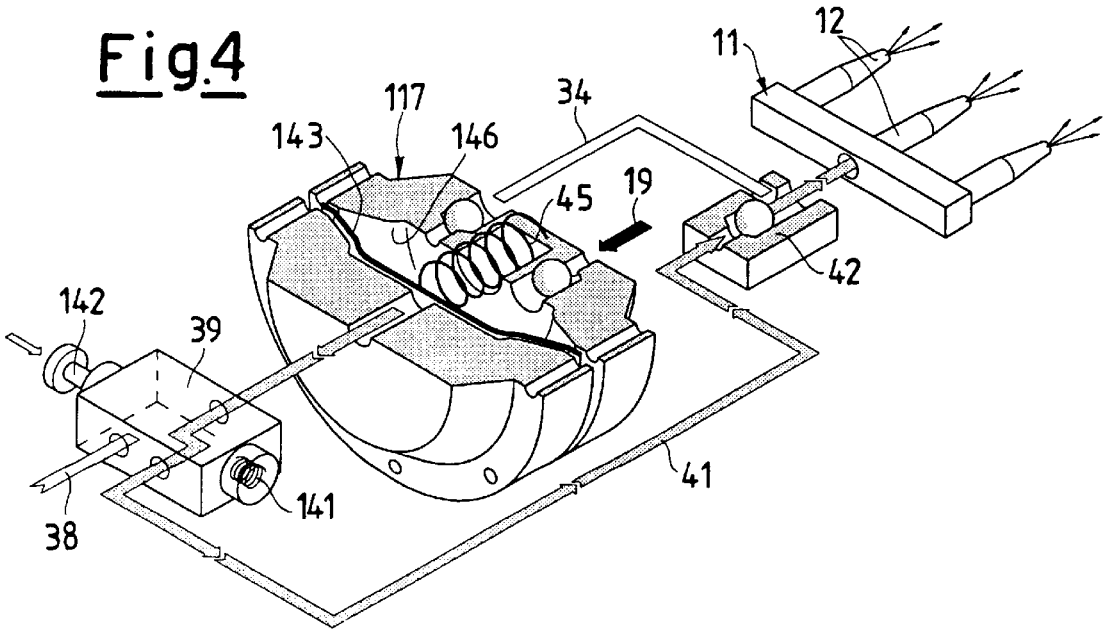

In FIGS. 3 and 4 it is shown a different and alternative realisation scheme of both the second pumping element 17 and the three-way valve 39 with the corresponding connections to the series of ducts 11. The pumping element, previously indicated by a pumping cylinder 17, is shown as a diaphragm pump 117. This valve or valve element 39 is normally open in a first condition of the washing phase and said valve allows the connection between the control air source 30 and an inner control chamber 44 or 144 of the pumping element 17 or 117, see FIGS. 1 and 3. FIG. 1 shows also that the valve or the valve group 39 can subsequently be controlled by the air, which is fed in excess, and which is not used to actuate the pumping element 17, until said valve is in the position shown in FIG. 2. The dispositions of the valve element 39 are obtained through the joint action of an elastic element 141 and of a small control cylinder 142.

As previously said, the feeding air, coming from the duct 38, goes into the valve element 39 and arrives in the inner control chamber 44 or 144 of the pumping element 17 or 117. In this way, in the example of FIG. 3, the air causes a diaphragm 143 belonging to the diaphragm pump 117 to move to reach its limit end; in the example of FIG. 1, the air pushes and moves a piston 43 of the pumping cylinder 17 to reach its stroke end as well.

In this way, the air causes an amount of clean liquid, previously sucked from the container 21, to be sent to the series of ducts 11.

In the meantime, a portion of the feeding air goes into the other valve or valve element 40 and feeds the small cylinder 142 connected to the above mentioned valve group 39. In this way the valve positioning is changed. As a consequence, the configuration of the valve element 39 has the arrangement shown in FIG. 2 and the valve element 39 is in its second position which is able to connect the air coming back from chamber 44, 144 of the pumping element 17, 117 towards duct 41.

This can occur because, in the two examples of pumping elements 17 or 117, an elastic element 45 is provided, said element pushes the piston 43 or the diaphragm 143 back to their rest positions shown in FIGS. 2 and 4. Two additional operations are performed during said movement, caused by the elastic element 45, towards the rest position.

The first operation, as already said, brings the air from the chamber 44, 144 to the duct 41 and from there to the series of ducts 11. A second operation comprises the phase of sucking the clean liquid 23 from the container 21 into the second chamber 46, 146 in order to be ready to be subsequently sent into the series of ducts 11.

There are then alternate, repetitive inputs, into the series of ducts 11, of small amounts of liquid and of amounts of air, and said inputs last few seconds.

Naturally, this continues until the rotating control cam 32 of the timer actuates the valve 37.

The nozzles 12, during this washing phase with clean liquid, will then be subject to a spraying action with a minimum amount of liquid alternate with amounts of air which increase the cleaning performances and the jet strength.

Naturally, it is also possible to simultaneously feed small amounts of liquid and amounts of air through specific valve systems, not shown, which further increase the cleaning performances and the strength of the so generated jet.

On the other hand, during the washing phase with the dirty liquid 22 contained in the container 20, the washing operation is constant, for a duration of three-four minutes, and is caused by the action of the rotating control cam 32 on the valve 28.

Also in this case, in a first working condition, the sucking action of the dirty fluid 22 from the container 20 into the chamber 50 is obtained through the valve group 27, which is controlled through the three-way valve 28. Then, in the second working condition, the air sent into the other chamber 51 causes the fluid to pass into the series of ducts 11, to exit from said ducts 11 through the nozzles 12 and to come into forceful contact with the dirty guns 13 and tanks 14 which have to be cleaned.

Then, in a first phase, the timer actuates, through the rotating control cam 32, the first pumping element 16 and the normal washing operation of the guns 13 and of the tanks 14 positioned in the tank 10 of the apparatus is executed.

In a second phase, said timer actuates the second pumping element 17 or 117 and the final washing operation of said guns and tanks is executed, making them ready for being used again. Audio or light signals can be provided to signal the end of the full washing cycle.

FIG. 5 shows a perspective view of the plate 15 of the tank 10 with the series of ducts 11 and of the corresponding nozzles 12 which are positioned thereon and on the plate 15.

Further, in the figure, some elements are shown in an exploded view, said elements are used as auxiliary elements for the washing operation. Among said elements, a hook 53, with a corresponding plug 54, suitable to pull the trigger 55 of a spray gun 13 should be noted. Three different realisations of a specific nozzle 112 to receive a gun 13 or the likes, nozzles 212 to receive the tank 14 and a support 56 for a cover 57 should also be noted.

Figure 6:
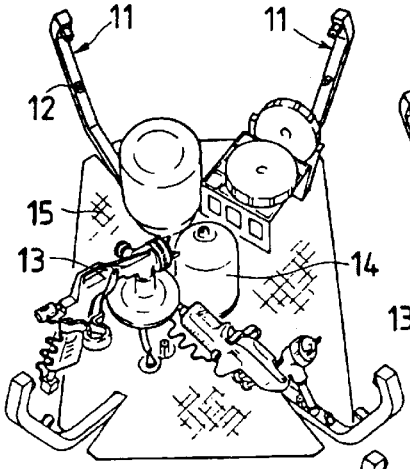
FIGS. 6, 7 and 8 show perspective views, in a reduced scale if compared to FIG. 5, of different arrangements within the tank for the various components to be washed.
Figure 7:
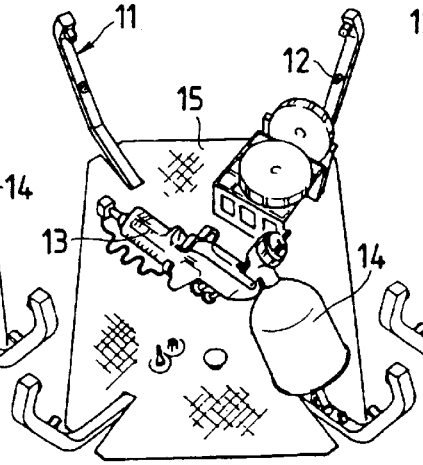
Figure 8:
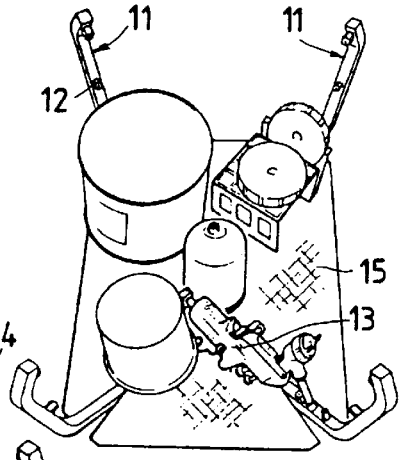

FIGS. 6, 7 and 8 show, in three corresponding perspective views, various, alternative and different types of arrangements which can be realised inside the tank 10 on the plate 15 for the various components to be washed which have been previously mentioned.

The advantage of this apparatus is that it is very simple to manufacture and that its use is very practical since all the various operations are automatic, thanks to the timer and to the control cam.

With reference to the above description and to the relative figures, it is evident that, by providing two pumping elements, one for the dirty liquid and one for the clean liquid, an improved washing operation is obtained.

Further, by providing a discontinuous air feeding during the washing phase with clean liquid, the use of large amounts of liquid is avoided with consequent significant saving in the liquid consumption.

The purpose indicated in the preamble has then been achieved, said purpose allows the washing apparatus for spray guns and their components to work in a simple manner and at lower costs.

Naturally, the embodiments of the valves and of the valve groups and, above all, of the portion related to their command and control devices can be different from the embodiments shown as a non limiting example in the drawings.

The invention is therefore protected by the appended claims.

I claim:

1. An automatic and manual washing apparatus for washing spray guns or their components which is capable of working under variable conditions, said apparatus comprising a frame structure, provided with an area where a washing tank (10) is located and an area wherein feeding systems and auxiliary elements which comprise pumping elements, valves and tanks belonging to the apparatus are located, a series of ducts (11) being connected to said washing tank (10) in order to distribute a washing fluid, said ducts being provided with a series of nozzles (12, 112, 212) suitable to direct cross jets towards a spray gun body (13) and a tank (14) for use with said spray guns, said series of ducts (11) being connected to at least one pumping element (16, 17, 117) which is connected through a duct (18, 19) to a washing liquid tank (20, 21) characterised by providing two pumping elements (16, 17, 117) respectively connected to a dirty liquid tank (20) and to a clean liquid tank (21), said pumping element (17, 117) of said cleaning tank (21) can be operatively connected, through its two chambers (44, 144, 46, 146), to said series, of ducts (11) in order to feed clean liquid and air to said nozzles (12, 112, 212).

2. An apparatus as claimed in claim 1, characterised in that said pumping element (17, 117) can be operatively connected to said two chambers (44, 144; 46, 146) through a timer (32) which selectively actuates a valve element (37) in order to command a valve group (36) which controls the continuous motion of said liquid pumping element (17, 117) through the feeding of control air (30).

3. An apparatus as claimed in claim 1, characterised in that said pumping element (17, 117) of the clean liquid is a piston pump (17).

4. An apparatus as claimed in claim 1, characterised in that said pumping element (17, 117) of the clean liquid is a diaphragm pump (117).

5. An automatic and manual washing apparatus for washing spray guns or their components which is capable of working under variable conditions, said apparatus comprising a frame structure, provided with an area where a washing tank (10) is located and an area wherein feeding systems and auxiliary elements which comprise pumping elements, valves and tanks belonging to the apparatus are located, a series of ducts (11) being connected to said washing tank (10) in order to distribute a washing fluid, said ducts being provided with a series of nozzles (12, 112, 212) suitable to direct cross jets towards a spray gun body (13) and a tank (14) for use with said spray guns, said series of ducts (11) being connected to at least one pumping element (16, 17, 117) which is connected through a duct (18, 19) to a washing liquid tank (20, 21) characterised by providing two pumping elements (16, 17, 117) respectively connected to a dirty liquid tank (20) and to a clean liquid tank (21), said pumping element (17, 117) of said cleaning tank (21) can be operatively connected, through its two chambers (44, 144, 46, 146), to said series, of ducts (11) in order to feed clean liquid and air to said nozzles (12, 112, 212) wherein said pumping element (17, 117) can be operatively connected to said two chamber (44, 144; 46, 146) through a timer (32) which selectively actuates a valve element (37) in order to command a valve group (36) which controls a continuous motion of said liquid pumping element (17, 117) through a feeding of control air (30) wherein said control valve group (36) for the continuous motion of said pumping element (17, 117) comprises a first valve element (39) driven by a second valve element (40), said first valve element (39) being capable of being selectively connected to said control air (30), to feed said clean liquid, which is inside a first chamber (46, 146) of said pumping element (17, 117) to feed air contained in said second chamber, through a duct (41), into said series of ducts (11).

6. An automatic and manual washing apparatus for washing spray guns or their components which is capable of working under variable conditions, said apparatus comprising a frame structure, provided with an area where a washing tank (10) is located and an area wherein feeding systems and auxiliary elements which comprise pumping elements, valves and tanks belonging to the apparatus are located, a series of ducts (11) being connected to said washing tank (10) in order to distribute a washing fluid, said ducts being provided with a series of nozzles (12, 112, 212) suitable to direct cross jets towards a spray gun body (13) and a tank (14) for use with said spray guns, said series of ducts ( 11) being connected to at least one pumping element (16, 17, 117) which is connected through a duct (18, 19) to a washing liquid tank (20, 21) characterised by providing two pumping elements (16, 17, 117) respectively connected to a dirty liquid tank (20) and to a clean liquid tank (21), said pumping element (17, 117) of said cleaning tank (21) can be operatively connected, through its two chambers (44, 144, 46, 146), to said series, of ducts (11) in order to feed clean liquid and air to said nozzles (12, 112, 212) wherein said pumping element (17, 117) can be operatively connected to said two chamber (44, 144; 46, 146) through a timer (32) which selectively actuates a valve element (37) in order to command a valve group (36) which controls a continuous motion of said liquid pumping element (17, 117) through a feeding of control air (30) wherein said control valve group (36) for the continuous motion of said pumping element (17, 117) comprises a first valve element (39) driven by a second valve element (40), said first valve element (39) being capable of being selectively connected to said control air (30), to feed said clean liquid, which is inside a first chamber (46, 146) of said pumping element (17, 117) to feed air contained in said second chamber, through a duct (41), into said series of ducts (11), further comprises an elastic element (45) suitable to cause the discharge of the air contained in said chamber (44, 144).

* * * * *